US011561056B2

(12) United States Patent
Perle et al.

(10) Patent No.: US 11,561,056 B2
(45) Date of Patent: Jan. 24, 2023

(54) WORKPIECE FOR PRODUCING A FIREARM

(71) Applicants: Collin M. Perle, Plainfield, IL (US); Nathaniel J. Perle, Plainfield, IL (US)

(72) Inventors: Collin M. Perle, Plainfield, IL (US); Nathaniel J. Perle, Plainfield, IL (US)

( * ) Notice: Subject to any disclaimer, the term of this patent is extended or adjusted under 35 U.S.C. 154(b) by 0 days.

(21) Appl. No.: 17/335,281

(22) Filed: Jun. 1, 2021

(65) Prior Publication Data

US 2022/0381526 A1 Dec. 1, 2022

(51) Int. Cl.
*F41A 3/66* (2006.01)
*F41A 17/44* (2006.01)
*F41A 99/00* (2006.01)

(52) U.S. Cl.
CPC ..... *F41A 3/66* (2013.01); *F41A 17/44* (2013.01); *F41A 99/00* (2013.01)

(58) Field of Classification Search
CPC .. F41A 3/66; F41A 17/44; F41A 99/00; F41A 35/00; B23P 15/00
See application file for complete search history.

(56) References Cited

U.S. PATENT DOCUMENTS 8,484,877 B2 7/2013 Zimmerman
11,000,930 B1 * 5/2021 Partington ..... B23Q 17/2233
2019/0039192 A1 * 2/2019 Smith ..... F41A 3/66

* cited by examiner

*Primary Examiner* — J. Woodrow Eldred
(74) *Attorney, Agent, or Firm* — Bennet K. Langlotz; Langlotz Patent & Trademark Works, LLC

(57) ABSTRACT

Workpieces for producing a firearm have an elongated body defined within a cross-sectional profile with a first elongated passage configured to receive the upper portion of the bolt, and with a second elongated passage configured to receive the lower portion of the bolt, and the elongated body having a separator between the first elongated passage and the second elongated passage and configured to prevent installation of the bolt assembly when the separator is present, and to enable installation of the bolt assembly when the separator is absent. The cross-sectional profile may be along the entire length of the elongated body. The cross-sectional profile may fully encompass the first elongated passage. The first elongated passage may be open only at the ends of the elongated body. The cross-sectional profile may have a U-shaped cross-section.

12 Claims, 10 Drawing Sheets

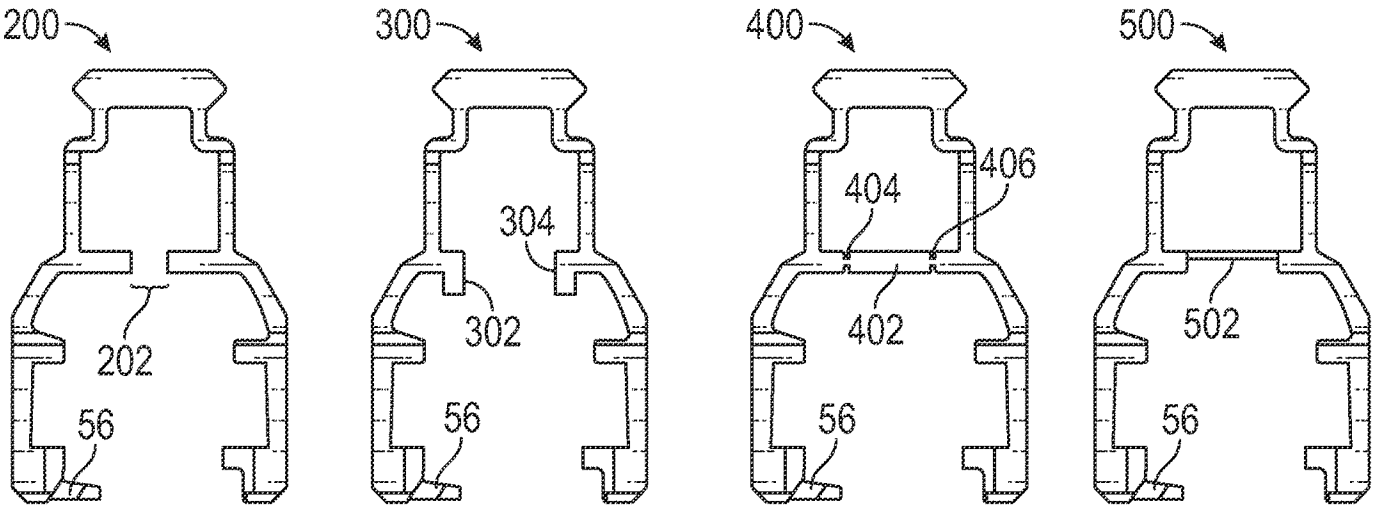
FIG. 9A
FIG. 9B
FIG. 9C
FIG. 9D
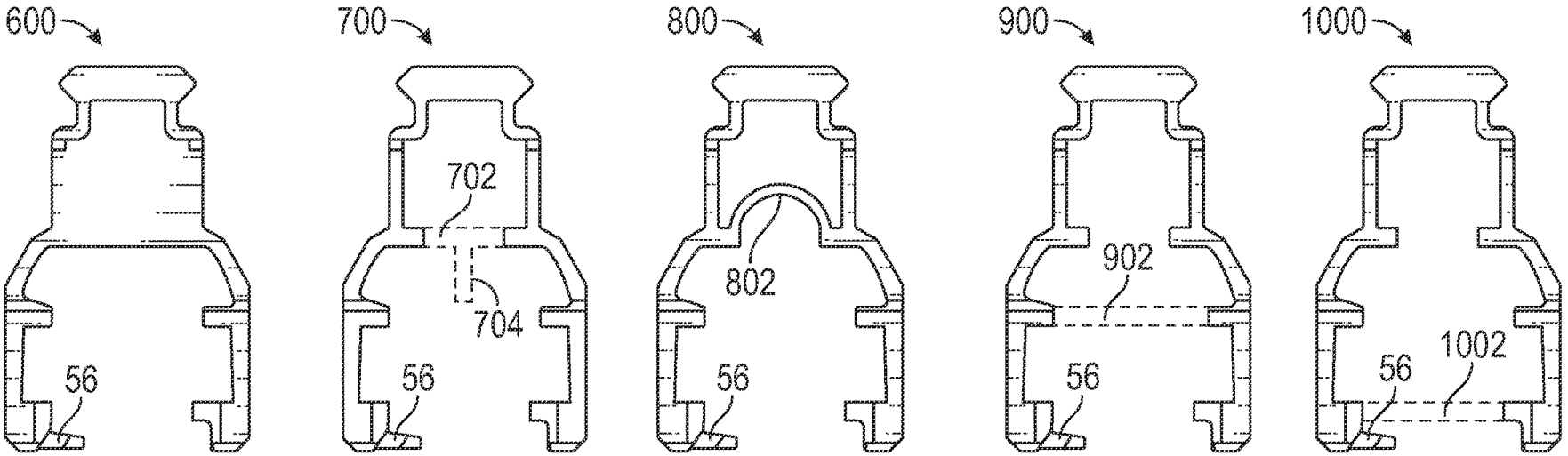
FIG. 9E
FIG. 9F
FIG. 9G
FIG. 9H
FIG. 9I

WORKPIECE FOR PRODUCING A FIREARM

FIELD OF THE INVENTION

The present invention relates to firearms, and more particularly to a workpiece for producing a firearm that preserves a denial feature configured to prevent installation of at least one of a bolt assembly and a barrel assembly in the workpiece.

BACKGROUND AND SUMMARY OF THE INVENTION

Workpieces for producing a firearm are workpieces that have been machined to form selected limited features, but have not yet reached a stage of manufacture to be legally considered a firearm. The Gun Control Act of 1968 does not impose restrictions on receiver blanks that do not meet the legal definition of a firearm, enabling anyone to purchase them in most jurisdictions. The purchaser can, in most jurisdictions, legally machine the receiver blank into a functioning firearm for personal use without being required to possess a Federal Firearms License, pass a background check, fill out a Firearm Transaction Record, Form 4473, or apply a serial number to the firearm. However, the purchaser cannot legally make the receiver blank into a firearm with the intent to sell it without possessing a Federal Firearms License, or if they are a prohibited person.

To ensure the receiver blank is not legally considered a firearm, many manufacturers leave significant parts of the receiver blank completely solid. However, this requires the purchaser to possess expensive machining tools and considerable skill to machine the receiver blank into a functioning firearm.

Therefore, a need exists for a new and improved workpiece for producing a firearm that ensures the receiver blank is not legally considered a firearm by including a denial feature configured to prevent installation of at least one of a bolt assembly and a barrel assembly in the workpiece, while enabling the purchaser to not require highly sophisticated machining tools and skills to remove the denial feature to produce a functioning firearm. The present invention substantially departs from the conventional concepts and designs of the prior art, and in doing so provides an apparatus primarily developed for the purpose of enabling the purchaser to not require highly sophisticated machining tools to remove a denial feature to produce a functioning firearm, yet still not be readily convertible to a firearm by itself.

The present invention provides an improved workpiece for producing a firearm, and overcomes the above-mentioned disadvantages and drawbacks of the prior art. As such, the general purpose of the present invention, which will be described subsequently in greater detail, is to provide an improved workpiece for producing a firearm that has all the advantages of the prior art mentioned above.

To attain this, the preferred embodiment of the present invention essentially comprises an elongated body defined within a cross-sectional profile with a first elongated passage configured to receive the upper portion of the bolt, and with a second elongated passage configured to receive the lower portion of the bolt, and the elongated body having a separator between the first elongated passage and the second elongated passage and configured to prevent installation of the bolt assembly when the separator is present, and to enable installation of the bolt assembly when the separator is absent. The cross-sectional profile may be along the entire length of the elongated body. The cross-sectional profile may fully encompass the first elongated passage. The first elongated passage may be open only at the ends of the elongated body. The cross-sectional profile may have a U-shaped cross section. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

FIG. 9A is a cross-section view of a first alternative embodiment of the workpiece for producing a firearm of FIG. 1 showing a raw extrusion profile prior to any machining.

FIG. 9B is a cross-section view of a second alternative embodiment of the workpiece for producing a firearm of FIG. 1 showing a raw extrusion profile prior to any machining.

FIG. 9C is a cross-section view of a third alternative embodiment of the workpiece for producing a firearm of FIG. 1 showing a raw extrusion profile prior to any machining.

FIG. 9D is a cross-section view of a fourth alternative embodiment of the workpiece for producing a firearm of FIG. 1 showing a raw extrusion profile prior to any machining.

FIG. 9E is a cross-section view of a fifth alternative embodiment of the workpiece for producing a firearm of FIG. 1 showing a raw extrusion profile prior to any machining.

FIG. 9F is a cross-section view of a sixth alternative embodiment of the workpiece for producing a firearm of FIG. 1 showing a raw extrusion profile prior to any machining.

FIG. 9G is a cross-section view of a seventh alternative embodiment of the workpiece for producing a firearm of FIG. 1 showing a raw extrusion profile prior to any machining.

FIG. 9H is a cross-section view of a eighth alternative embodiment of the workpiece for producing a firearm of FIG. 1 showing a raw extrusion profile prior to any machining.

FIG. 9I is a cross-section view of a ninth alternative embodiment of the workpiece for producing a firearm of FIG. 1 showing a raw extrusion profile prior to any machining.

The same reference numerals refer to the same parts throughout the various figures.

DESCRIPTION OF THE CURRENT EMBODIMENT

Figure 1:
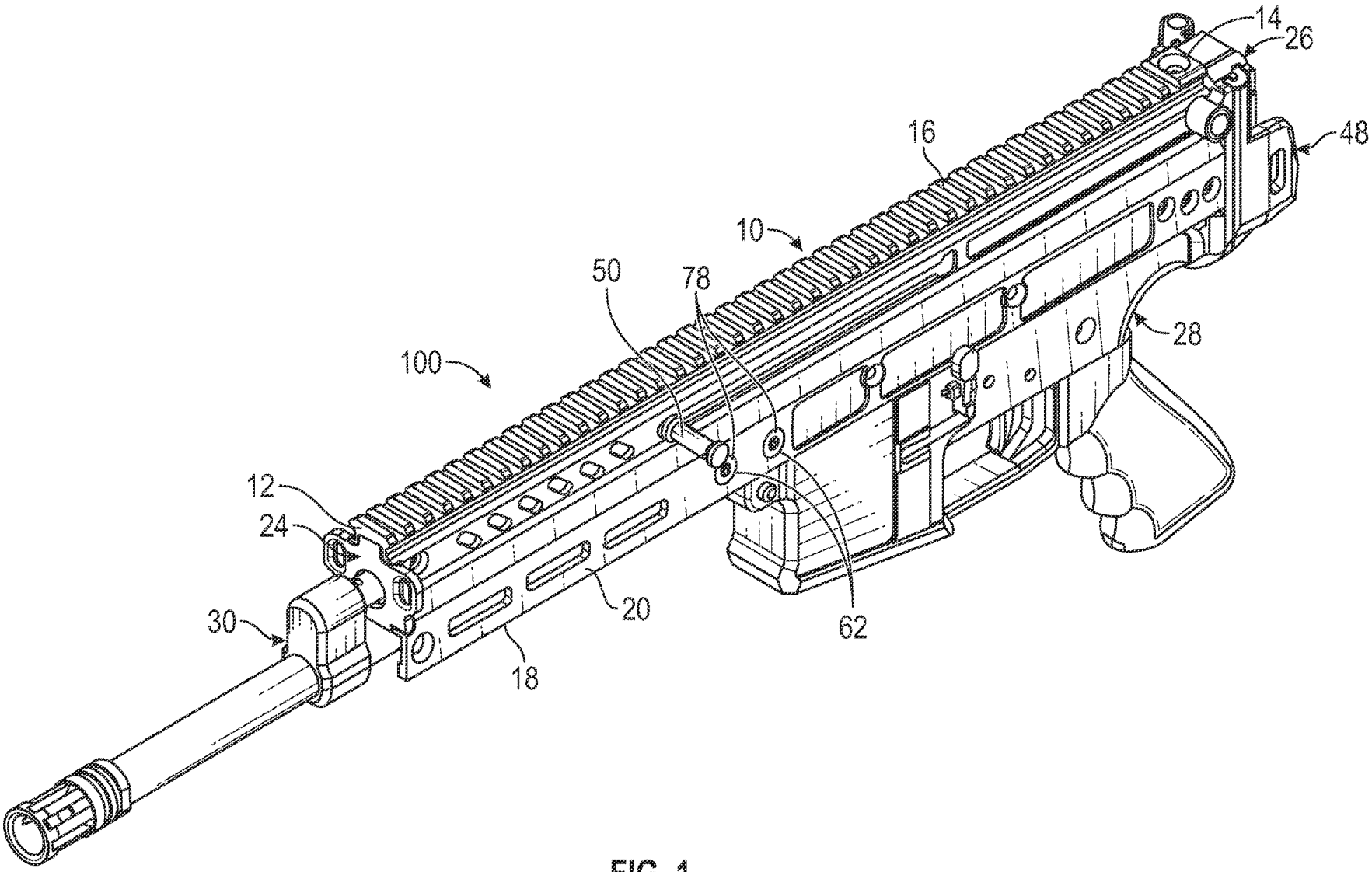
FIG. 1 is a top isometric view of the current embodiment of a workpiece for producing a firearm constructed in accordance with the principles of the present invention having been machined and assembled into a functioning firearm.

An embodiment of the workpiece for producing a firearm of the present invention is shown and generally designated by the reference numeral 10.

Figure 2:
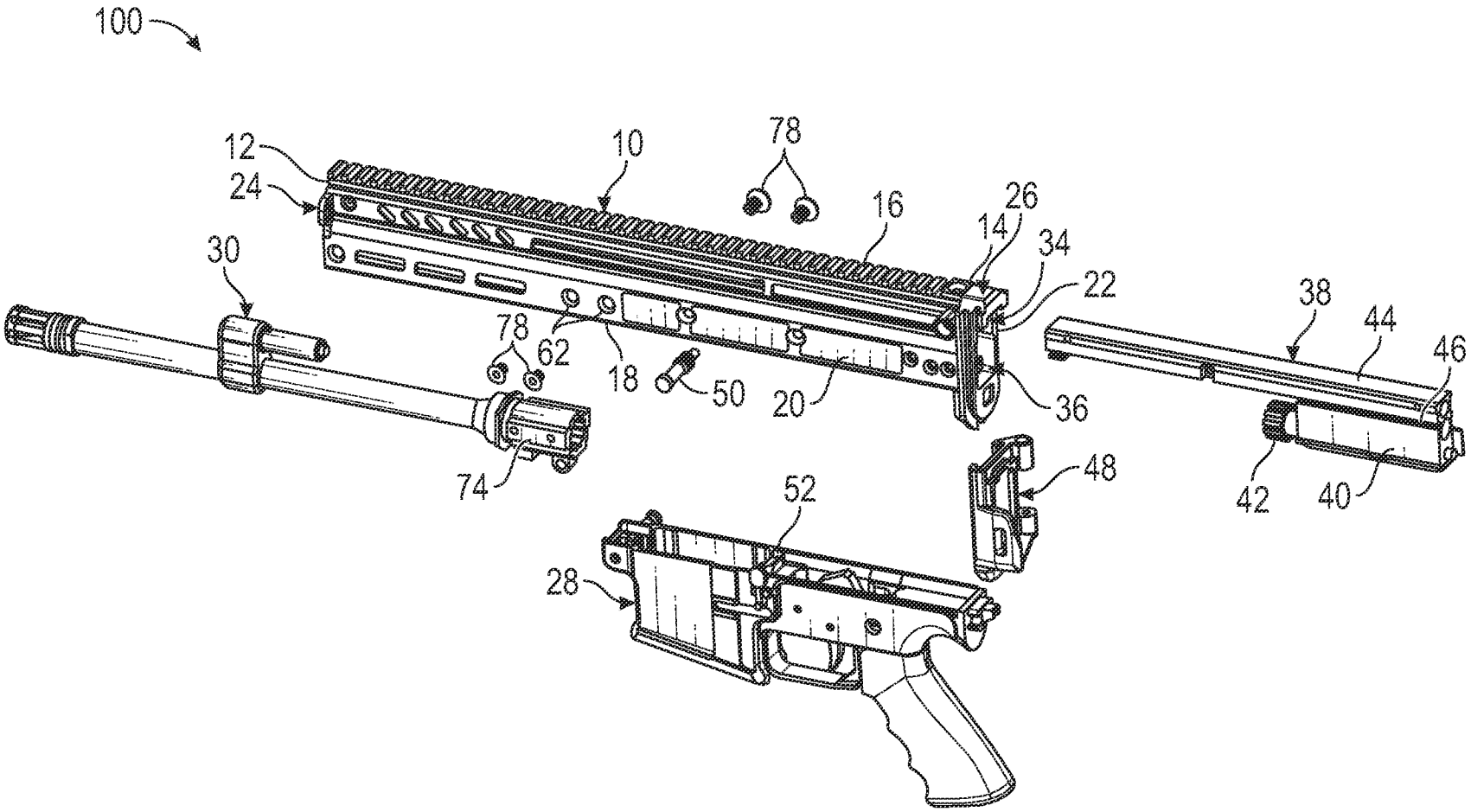
FIG. 2 is an exploded view of the functioning firearm of FIG. 1.

FIGS. 1 & 2 illustrate the improved workpiece for producing a firearm 10 of the present invention. More particularly, FIG. 1 shows the workpiece for producing a firearm in use having been machined by a first manufacturer and a second manufacturer and assembled by the second manufacturer into a functioning firearm 100. The workpiece serves as an upper receiver and has a front 12, rear 14, top 16, bottom 18, left side 20, and right side 22. A front plate 24 is attached to the front, and a rear plate 26 is attached to the rear. A trigger module 28 is attached to the bottom rear of the workpiece. A barrel assembly 30 is attached to the front of the workpiece forward of the trigger module. The workpiece is an elongated body defined within a cross-sectional profile with a first elongated passage 34 and a second elongated passage 36. A bolt assembly 38 has a lower bolt portion 40 including a bolt 42 and an upper portion 44 joined to the lower bolt portion at a junction portion 46. The upper portion of the bolt is received within the first elongated passage, and the lower portion of the bolt is received within the second elongated passage. A rear plate adapter 48 that accepts a pistol brace or stock (not shown) is attached to the rear plate. A charging handle 50 protrudes from either the left, right, or both sides of the workpiece. The trigger module 28 ordinarily has a semi-automatic trigger group, including a semi-automatic sear, installed. However, in the event an automatic trigger group were to be improperly installed in the trigger module, an automatic sear 52 would be present as illustrated. In the current embodiment, the main components of the functioning firearm (the barrel assembly, trigger module, and upper receiver) are Fabrique Nationale (Herstal, Belgium) format and are not compatible with AR-15 parts. However, AR-15 accessories such as stocks, triggers, and sights, may be compatible with the functioning firearm.

Figure 3A:
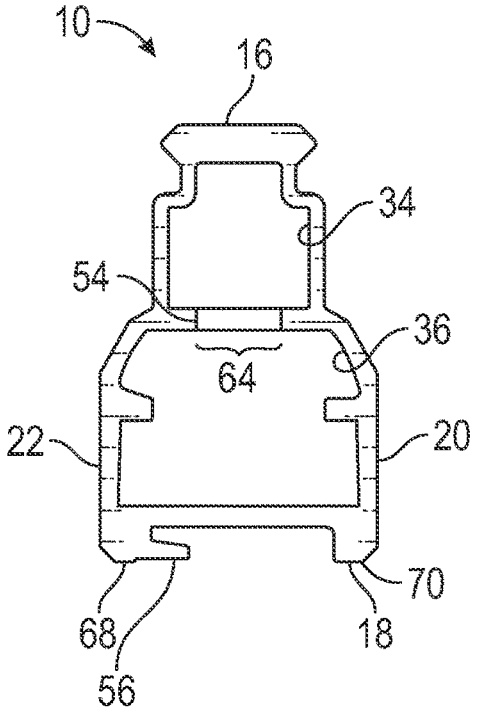
FIG. 3A is a cross-section view of the workpiece for producing a firearm of FIG. 1 showing a raw extrusion profile prior to any machining.
Figure 3B:
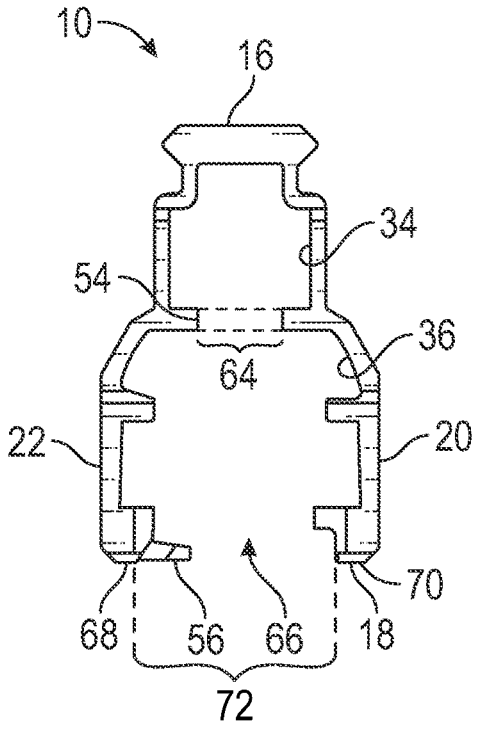
FIG. 3B is a cross-section view of the workpiece for producing a firearm of FIG. 1 after initial machining by the manufacturer to form selected limited features while preserving a denial feature.
Figure 3C:
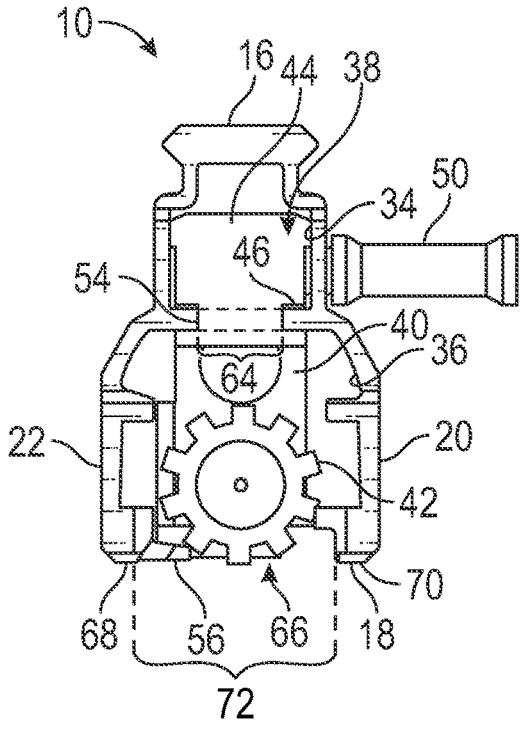
FIG. 3C is a cross-section view of the workpiece for producing a firearm of FIG. 1 after initial machining by the manufacturer showing how entry of the bolt carrier is denied. The dashed lines indicate how the denial feature is removed by subsequent machining by the purchaser to permit entry of the bolt carrier.

FIGS. 3A-C illustrate the improved workpiece for producing a firearm 10 of the present invention at various stages of manufacture. FIG. 3A shows the workpiece after a first manufacturer has extruded the workpiece with a selected raw extrusion profile, with no machining having taken place. At this stage, the workpiece is not legally a firearm. FIG. 3B shows the workpiece after the first manufacturer has machined the workpiece to form selected limited features while preserving a denial feature configured to prevent installation of at least one of the bolt assembly 38 and the barrel assembly 30 in the workpiece. At this stage, the workpiece is still not legally a firearm. FIG. 3C shows the how the denial feature prevents installation of the bolt assembly. The dashed portions of FIGS. 3B & C indicate where the second manufacturer, the purchaser, additionally machines the workpiece to remove the denial feature so the bolt assembly can be installed. At that point, the workpiece is legally a firearm.

The workpiece 10 has a separator 54 between the first elongated passage 34 and the second elongated passage 36. The separator, which is an unfinished bolt rail in the current embodiment, serves as a denial feature and is configured to prevent installation of the bolt assembly 38 when the separator is present and to enable installation of the bolt assembly when the separator is absent. The separator defines a gap 64 larger than the junction portion 46 of the bolt assembly.

Figure 4:
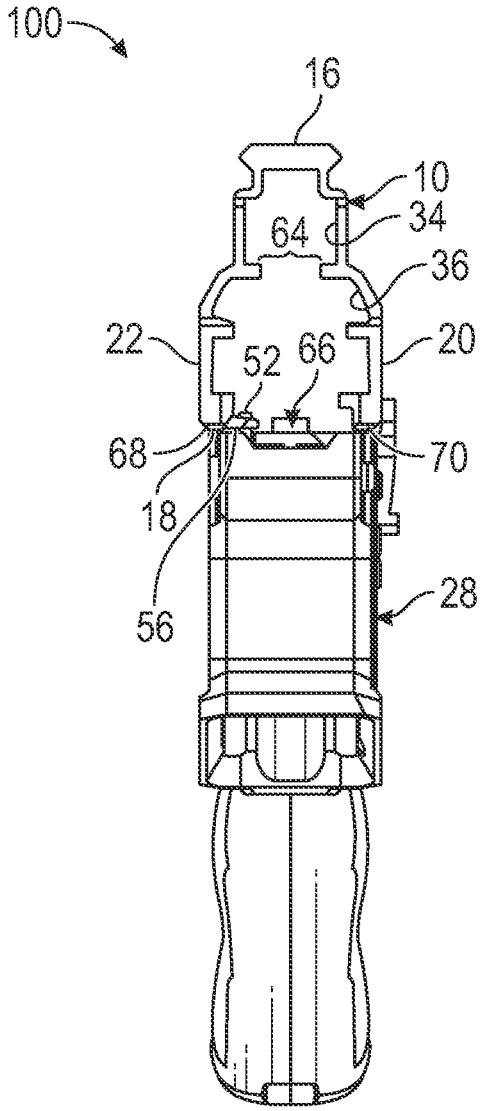
FIG. 4 is a cross-section view of the functioning firearm of FIG. 1 showing how a denial feature interferes with an auto-sear should one be improperly present in the trigger module.

FIG. 4 illustrates the improved workpiece for producing a firearm 10 of the present invention. More particularly, FIG. 4 shows the workpiece for producing a firearm in use having been machined and assembled into a functioning firearm 100. The trigger module 28 ordinarily has a semi-automatic trigger group, including a semi-automatic sear, installed. However, in the event an automatic trigger group were to be improperly installed in the trigger module, an automatic sear 52 would be present as illustrated. FIG. 4 shows how an interference 56 protrudes inwardly from the bottom right of the workpiece to interfere with the automatic sear and prevent the lower sear from attaching to the workpiece when an automatic trigger group is improperly present. The interference ensures the functioning firearm cannot be converted to fully automatic fire, which would make the functioning firearm illegal.

Figure 5A:
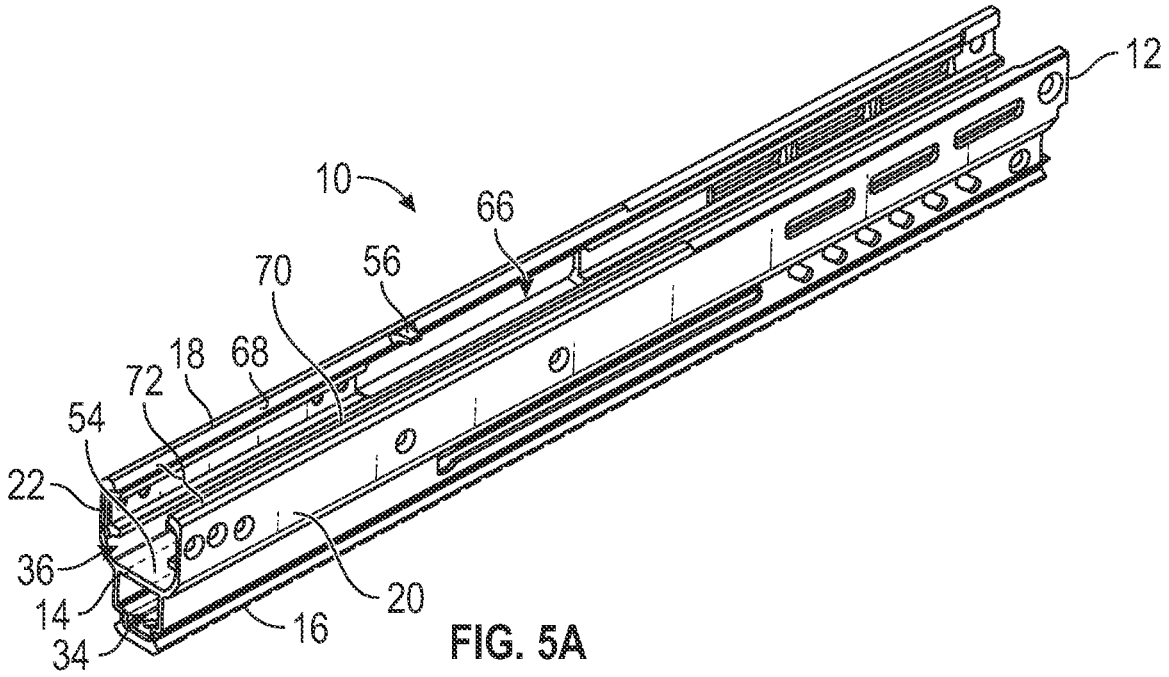
FIG. 5A is a bottom isometric view of the workpiece for producing a firearm of FIG. 1 after initial machining by the manufacturer to form selected limited features while preserving a denial feature.
Figure 5B:
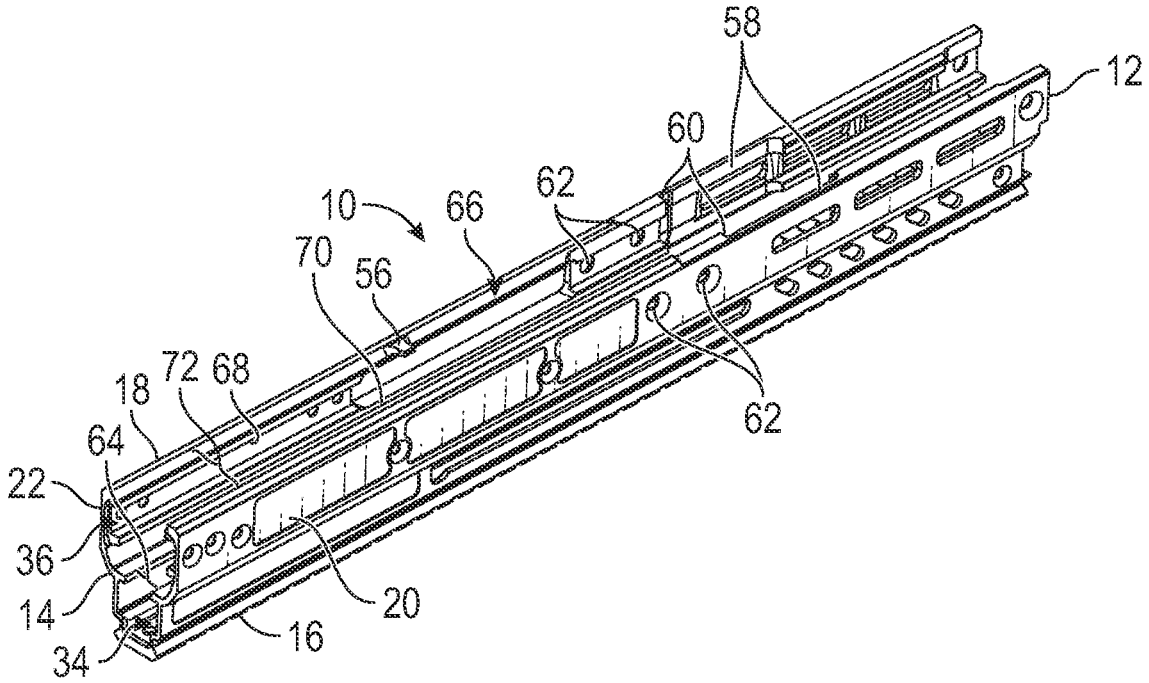
FIG. 5B is a bottom isometric view of the workpiece for producing a firearm of FIG. 1 after subsequent machining by the purchaser to remove the denial feature.

FIGS. 5A & B illustrate the improved workpiece for producing a firearm 10 of the present invention at various stages of manufacture. FIG. 5A shows the workpiece after the first manufacturer has machined the raw extrusion profile of the workpiece shown in FIG. 3A to form selected limited features while preserving a denial feature configured to prevent installation of at least one of the bolt assembly 38 and the barrel assembly 30 in the workpiece as shown in FIG. 3B. At this stage, the workpiece is still not legally a firearm. FIG. 5B shows the workpiece where the second manufacturer, the purchaser, has additionally machined the workpiece to remove the denial feature as shown by the dashed portions of FIG. 3C so the bolt assembly and the barrel assembly can be installed in the workpiece. At that point, the workpiece is legally a firearm. The additional machining shown in FIG. 5B includes removal of the separator 54 to enable installation of the bolt assembly and creation of barrel relief cuts 58, barrel notch 60, and countersunk screw holes 62 to enable installation of the barrel assembly.

It should be appreciated the cross-sectional profile is along the entire length of the workpiece. The cross-sectional profile fully encompasses the first elongated passage 34. The first elongated passage is open at the front and rear ends 12, 14 of the workpiece as well as various points along the sides of the workpiece. The cross-sectional profile has a U-shaped cross-section and an A-shaped cross-section. The second elongated passage 36 is open along its entire length on a side (bottom 18) away from the first elongated passage. The separator 54 is a continuous wall in the current embodiment, but can also be discontinuous. The cross-sectional profile defines a channel 66 open along one side (bottom 18) and defined between first and second opposed leg ends 68, 70. The leg ends define a gap 72 having a first width, and the second passage defines a second width greater than the first width and configured to closely receive a barrel portion 74 of the barrel assembly 30, such that installation of the barrel portion is denied by the leg ends. The barrel portion has a barrel portion width greater than the first width.

Figure 6A:
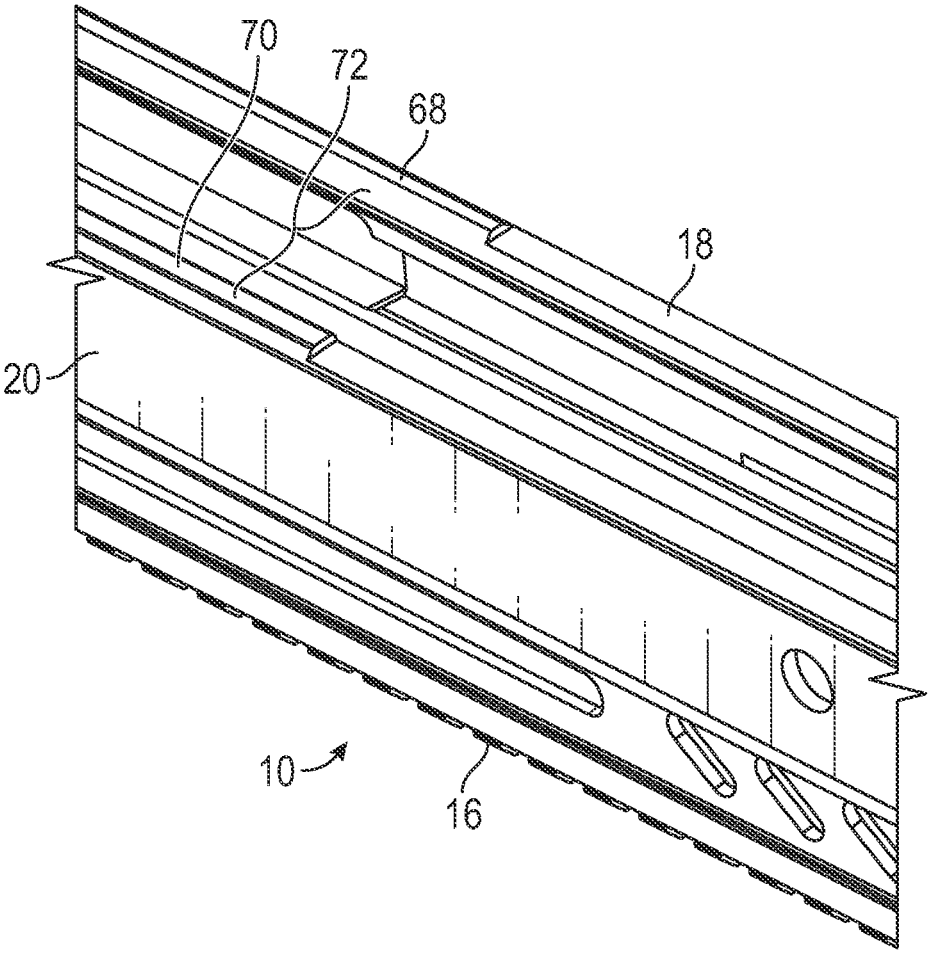
FIG. 6A is a bottom fragmentary view of the workpiece for producing a firearm of FIG. 1 after initial machining by the manufacturer to form selected limited features while preserving a denial feature that prevents installation of the barrel assembly.
Figure 6B:
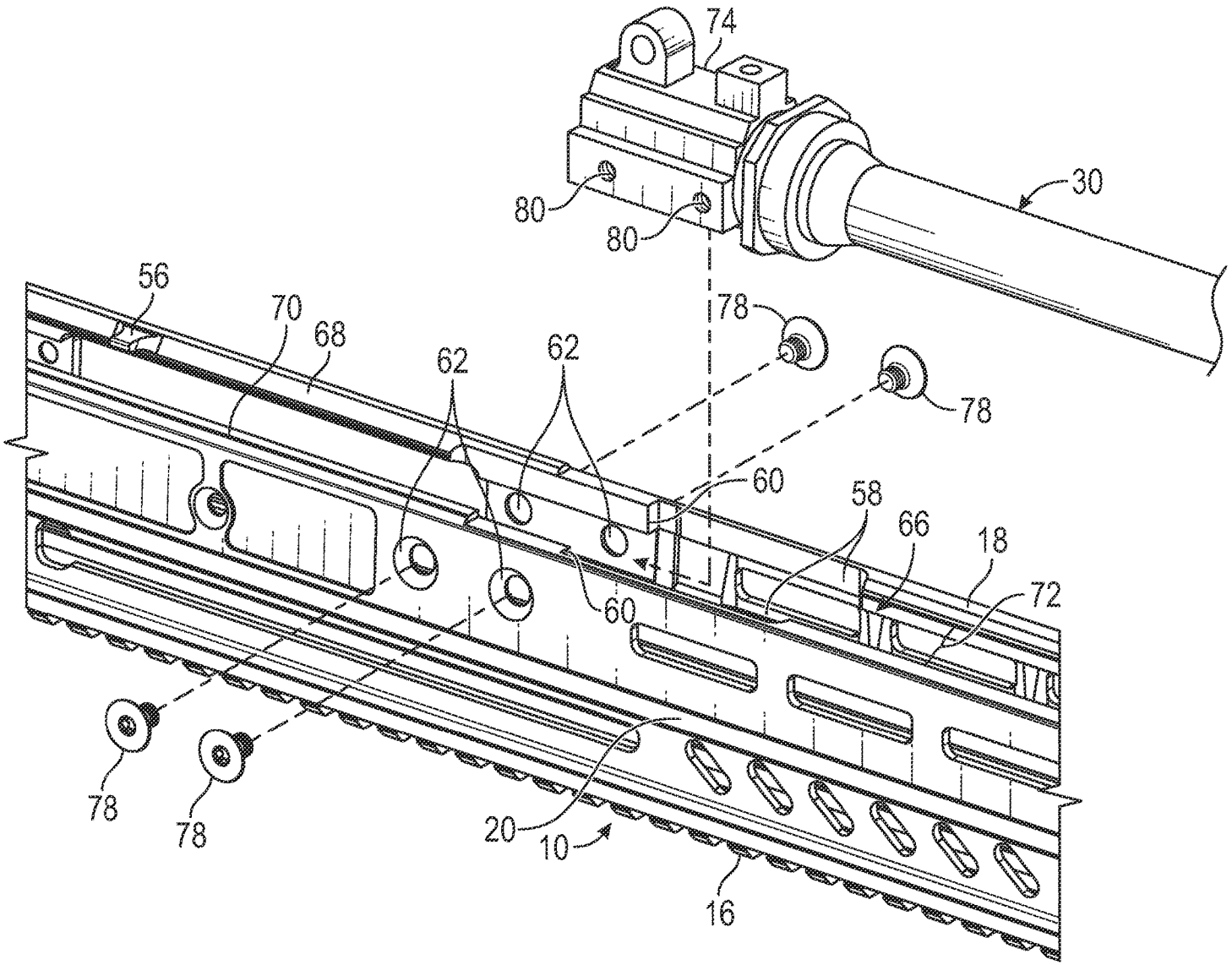
FIG. 6B is an exploded bottom fragmentary view of the workpiece for producing a firearm, barrel assembly, and screws of FIG. 1 showing how the barrel assembly is inserted and secured within the workpiece after subsequent machining by the purchaser to remove the denial feature.
Figure 7:
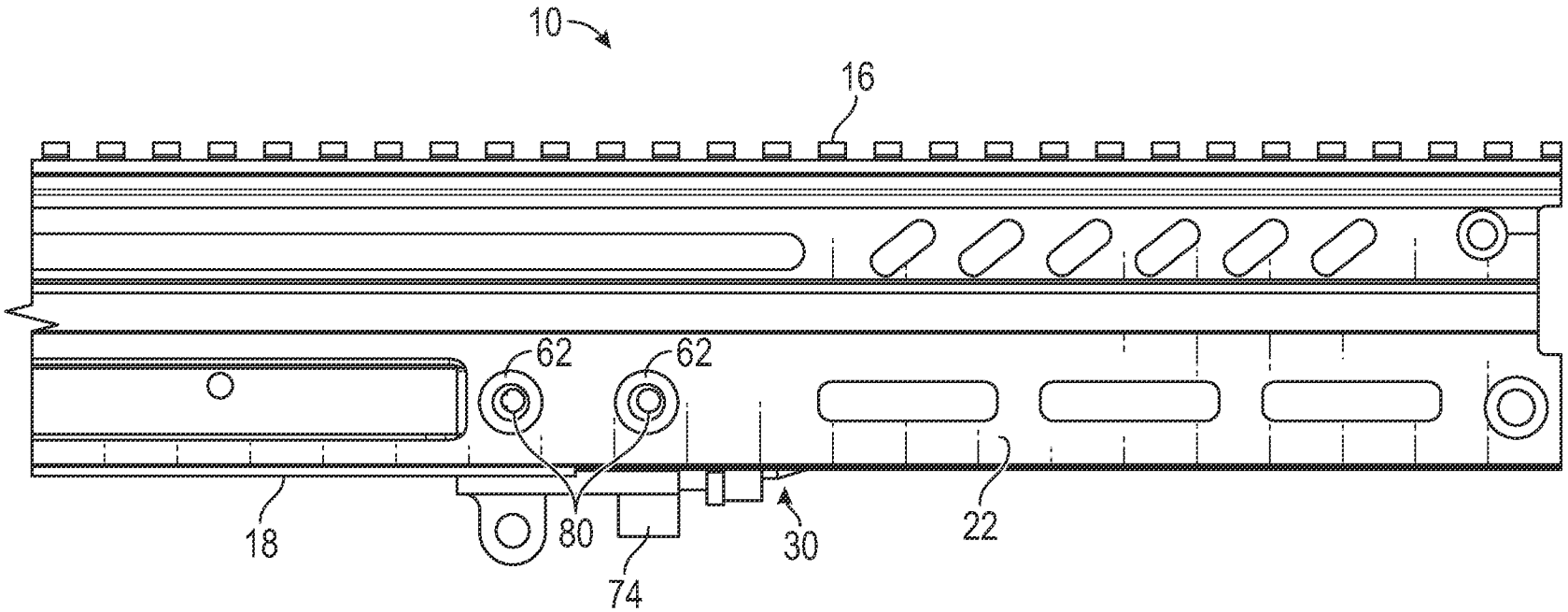
FIG. 7 is a right side fragmentary view of the workpiece for producing a firearm of FIG. 1 after subsequent machining by the purchaser showing how the screw holes on the workpiece and the barrel assembly are intentionally misaligned to force the barrel assembly down and rearward as the screws are tightened.
Figure 8A:
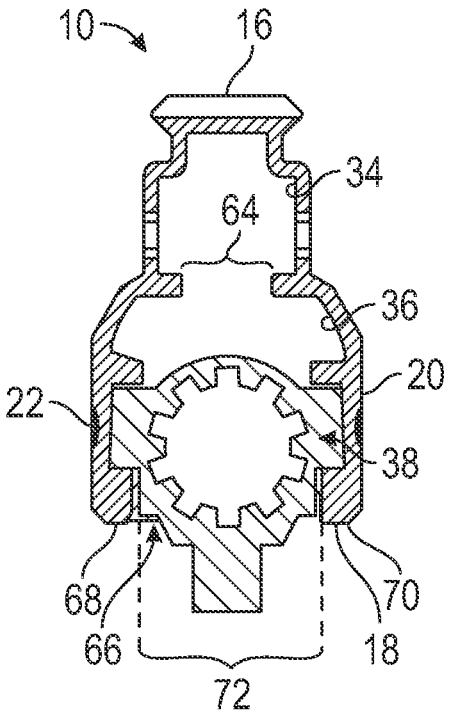
FIG. 8A is a cross-section view of the workpiece for producing a firearm of FIG. 1 showing the barrel assembly inserted and secured within the workpiece after subsequent machining by the purchaser to remove the denial feature.
Figure 8B:
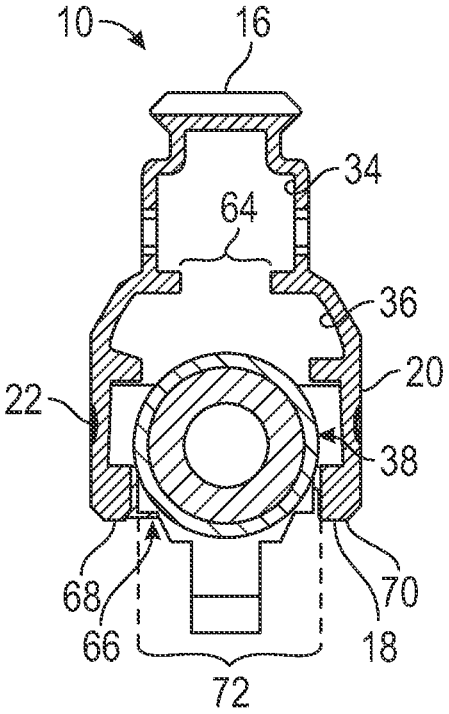
FIG. 8B is a cross-section view of the workpiece for producing a firearm of FIG. 1 showing the barrel assembly inserted and secured within the workpiece after subsequent machining by the purchaser to remove the denial feature.
Figure 8C:
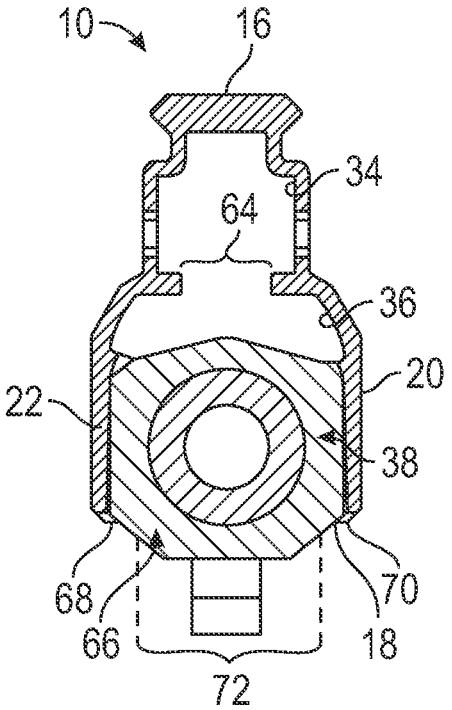
FIG. 8C is a cross-section view of the workpiece for producing a firearm of FIG. 1 showing the barrel assembly inserted and secured within the workpiece after subsequent machining by the purchaser to remove the denial feature.
Figure 8D:
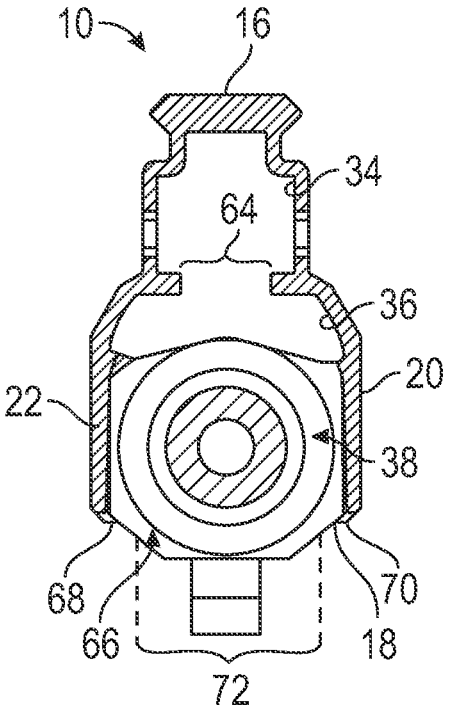
FIG. 8D is a cross-section view of the workpiece for producing a firearm of FIG. 1 showing the barrel assembly inserted and secured within the workpiece after subsequent machining by the purchaser to remove the denial feature.

FIGS. 6A, B & 7 illustrate the improved workpiece for producing a firearm 10 of the present invention at various stages of manufacture. FIG. 6A shows the workpiece after the first manufacturer has machined the raw extrusion profile of the workpiece shown in FIG. 3A to form selected limited features while preserving a denial feature configured to prevent installation of at least one of the bolt assembly 38 and the barrel assembly 30 in the workpiece as shown in FIGS. 3B, 5A. FIGS. 6B & 7 shows the workpiece where the second manufacturer, the purchaser, has additionally machined the workpiece to remove the denial feature as shown by FIG. 5B and the dashed portions of FIG. 3C so the bolt assembly and the barrel assembly can be installed in the workpiece. At that point, the workpiece is legally a firearm.

Further machining of the workpiece 10 as shown in FIG. 6B creates barrel relief cuts 58, barrel notch 60, and countersunk screw holes 62 as shown in FIGS. 6A & 7 to enable installation of the barrel assembly 30 by inserting the barrel assembly downward and rearward into the bottom 18 of the workpiece as denoted by the dashed lines. The countersunk screw holes locate the screws 78 on the workpiece. The countersunk screw holes are deliberately machined out of axial alignment with screw holes 80 present in the barrel portion 74 of the barrel assembly. The misalignment pulls the barrel rearward and downward to ensure a solid connection with the barrel notch 60 when the screws are tightened as indicated by the arrows extending down and to the rear in FIG. 6B.

FIGS. 8A-D illustrate the improved workpiece for producing a firearm 10 of the present invention. More particularly, the workpiece has undergone machining by both manufacturers to remove the denial feature so the bolt assembly 38 and the barrel assembly 30 can be installed in the workpiece. Sufficient clearance exists where needed so the first and second elongated passages 34, 36 can receive the bolt assembly and barrel assembly so the workpiece can be assembled into a functioning firearm 100.

FIGS. 9A-I illustrate various alternative embodiments of selected profiles of the improved workpiece for producing a firearm 200-1000. These are profiles produced by the first manufacturer machining the workpiece to form selected limited features while preserving a denial feature configured to prevent installation of at least one of a bolt assembly and a barrel assembly in the workpiece. For all of these selected profiles, the workpiece is still not legally a firearm and is identical to the embodiment illustrated in FIG. 3B except where noted. In FIG. 9A, workpiece 200 has a small gap 202 that is insufficiently wide to permit installation of the bolt assembly 30 that can be widened by the second manufacturer. In FIG. 9B, workpiece 300 has two legs 302, 304 that obstruct installation of the bolt assembly that can be cut away by the second manufacturer. In FIG. 9C, workpiece 400 has a separator 402 with weakened portions 404, 406 on either side that obstructs installation of the bolt assembly that can be knocked out by the second manufacturer. In FIG. 9D, workpiece 500 has a separator 502 that is a thinner, weakened portion that obstructs installation of the bolt assembly that can be knocked out by the second manufacturer. In FIG. 9E, workpiece 600 omits the first elongated passage 34, which obstructs installation of the bolt assembly. The second manufacturer can create the first elongated passage. In FIG. 9F, workpiece 700 has a separator 702 with a downwardly extending leg 704 that obstructs installation of the bolt assembly and can be cut away by the second manufacturer. In FIG. 9G, workpiece 800 has a thinner, weakened, arcuate separator 802 that obstructs installation of the bolt assembly that can be knocked out by the second manufacturer. In FIG. 9H, workpiece 900 has a lowered separator 902 that obstructs installation of the bolt assembly that can be cut away by the second manufacturer. In FIG. 9I, workpiece 1000 has a lowered separator 1002 that obstructs installation of the bolt assembly that can be cut away by the second manufacturer. In the current embodiments, all of the selected profiles include the interference 56 protruding inwardly from the bottom right of the workpiece to interfere with an automatic sear 52 and prevent the trigger module 28 from attaching to the finished workpiece when an automatic trigger group is improperly present in the trigger module. The interference ensures the functioning firearm 100 cannot be converted to fully automatic fire, which would make the functioning firearm illegal, no matter which selected profile was created by the first manufacturer. Furthermore, all of these selected profiles are identical to the embodiment illustrated in FIG. 3C after further machining by the second manufacturer to produce the finished workpiece. It should be noted that the interference 56 is an optional feature and may or may not be present in the raw profile, or it may be included or removed by the first or the second manufacturer depending on the final configuration of the firearm. A rifle does not legally require the interference, but a pistol must include the interference to avoid being deemed an illegal configuration.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While current embodiments of a workpiece for producing a firearm have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A workpiece for producing a firearm configured to receive a bolt assembly having a lower bolt portion including a bolt, and an upper portion joined to the lower bolt portion at a junction portion, the workpiece comprising:

an elongated body defined within a cross-sectional profile with a first elongated passage configured to receive the upper portion of the bolt, and with a second elongated passage configured to receive the lower portion of the bolt; and the elongated body having a separator between the first elongated passage and the second elongated passage and configured to prevent installation of the bolt assembly when the separator is present, and to enable installation of the bolt assembly when the separator is absent.

2. The workpiece of claim 1 wherein the cross-sectional profile is along the entire length of the elongated body.

3. The workpiece of claim 1 where the cross-sectional profile fully encompasses the first elongated passage.

4. The workpiece of claim 1 wherein the first elongated passage is open only at the ends of the elongated body.

5. The workpiece of claim 1 wherein the cross-sectional profile has a U-shaped cross-section.

6. The workpiece of claim 1 wherein the second elongated passage is open along its entire length on a side away from the first elongated passage.

7. The workpiece of claim 1 wherein the separator is a continuous wall.

8. The workpiece of claim 1 wherein the separator defines a gap larger than the junction portion of the bolt assembly.

9. The workpiece of claim 1 wherein the cross-sectional profile has an A-shaped cross-section.

10. The workpiece of claim 1 wherein the cross-sectional profile defines a channel open along one side and defined between first and second opposed leg ends.

11. The workpiece of claim 10 wherein the leg ends define a gap having a first width, and the second elongated passage defines a second width greater than the first width and configured to closely receive a barrel portion, such that installation of the barrel portion is denied by the leg ends.

12. The workpiece of claim 11 wherein the barrel portion has a barrel portion width greater than the first width.

* * * * *